United States Patent [19]

Calabro

[11] Patent Number: 4,584,743

[45] Date of Patent: Apr. 29, 1986

[54] BELT BUCKLE

[76] Inventor: Anthony S. Calabro, 22 Oaklawn Ave., Cranston, R.I. 02920

[21] Appl. No.: 778,535

[22] Filed: Sep. 20, 1985

[51] Int. Cl.[4] ..... A44B 11/00; A44B 11/20

[52] U.S. Cl. ..... 24/180; 24/185; 24/191

[58] Field of Search ..... 24/180, 185, 186, 176, 24/177, 191, 192, 189, 199

[56] References Cited

U.S. PATENT DOCUMENTS

| | | | |
|---|---|---|---|
| 344,375 | 6/1886 | Haswell | 24/192 |
| 416,222 | 12/1889 | Harkey et al. | 24/180 |
| 419,173 | 1/1890 | Anguish | 24/180 |
| 1,062,715 | 5/1913 | Kjelden | 24/176 |
| 2,933,795 | 4/1960 | Meeker | 24/180 |
| 4,419,792 | 12/1983 | Kohli | 24/191 |
| 4,477,949 | 10/1984 | Calabro | 24/180 |

*Primary Examiner*—Victor N. Sakran
*Attorney, Agent, or Firm*—Barlow & Barlow

[57] ABSTRACT

A belt buckle of two piece construction has a removable top member. The base member has a pivoting locking plate therein that engages the butt end of a belt and a hook pin depending therefrom that engages apertures in the other end of a belt.

2 Claims, 6 Drawing Figures

BELT BUCKLE

BACKGROUND OF THE INVENTION

This invention relates to belt buckles and particularly a belt buckle which can be utilized with a number of belts and further can have top members which are interchangeable. The belt buckle construction of the present invention is particularly adapted for use with belt straps having a plurality of longitudinally spaced holes extending therethrough and a butt end.

Belt straps of the above general nature are exemplified by constructions such as that seen in the Kjelden Pat. U.S. No. 1,062,715, for example, and in my prior Pat. U.S. No. 4,477,949. It is desirable to have a buckle construction which may be readily mass produced by die casting without any undercut portions and one in which the decoration may be readily changed by the user.

SUMMARY OF THE INVENTION

According to the present invention, a two piece belt buckle construction is provided by separate body and top members that may be disconnected from each other. The body member has a pair of side plates that are interconnected by a shelf member and a depending cross bar at one end thereof, while the other end of the side plates are connected by a cam bar. Pivoted between the side plates is a locking plate that carries a jaw at one end to lie juxtaposed to the shelf and a hood at the other end adapted to engage one of a plurality of spaced holes in a belt strap. The top member has one end detachably engagable with the cam bar, the top plate having a caming surface that engages the locking plate to pivot the same and move the jaw up towards the shelf so that the butt end of a belt may be engaged at that location and positively gripped. Means are provided on the top plate that depend therefrom and engage locking means that may be conveniently located adjacent to shelf.

DESCRIPTION OF THE PREFERRED EMBODIMENT

Figure 1:
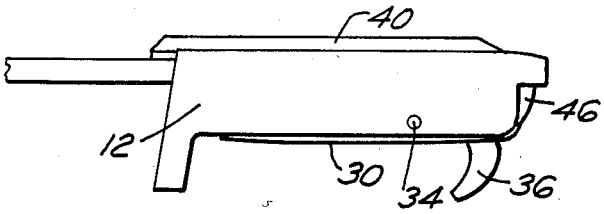
FIG. 1 is a side elevational view of the buckle of the present invention.

The belt buckle has a body member with a pair of side plates 12 and 14 which are joined together at one end by a cam bar 16 that has a recess 17 therein opening from the bottom. At the opposite end of the side plates there is formed an integral shelf 20 and depending from the lower edge of the side plates is a cross bar 22. As will be seen particlarly in FIGS. 2 and 3, the strap provides an opening between the side plates from the end of the buckle as viewed from the left as seen in the drawings. Made as part of the shelf is a stop plate 21 and affixed thereto is a bracket 24 which receives a spring 25, the purpose of which will be presently described.

Pivotally located within the side plates is a locking plate 30 which is pivoted to the side plates by a pivot pin 34 that extends through the side plates and a pair of ears 32 on the plate 30. The locking plate provided with a hook pin 36 extending downwardly therefrom at one end, the hook pin being adapted to engage an aperture in a belt. The other end of the locking plate is provided with a jaw portion 38, the action of which will be presently described.

The top member 40 is a generally planer body which may be provided on its outer surface with suitable decoration. Depending from the under surface 41 is a pin 44 with an enlarged head 45. The top member includes a hook-like cupped portion 46 at one end thereof which is adapted to engage the groove 17 and the cam bar 16. Extending below the cupped portion 46 is a protrusion 48, which protrusion acts to bear against one end of the locking plate 30. The top member as can be readily seen is free from any under cut portions and may be easily die cast in a two part mold. Also it is apparent that the various top members 40 may be provided with different decorations, colors, shapes and the like to create the impression of having a number of belt buckles for different occasions.

Figure 3:
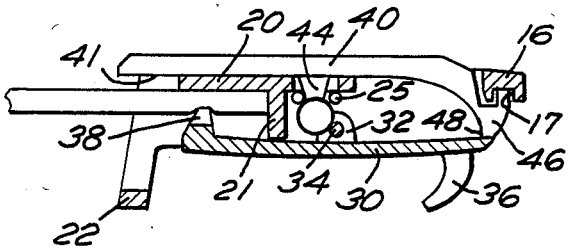
FIG. 3 is a similar view with the buckle in closed position.
Figure 2:
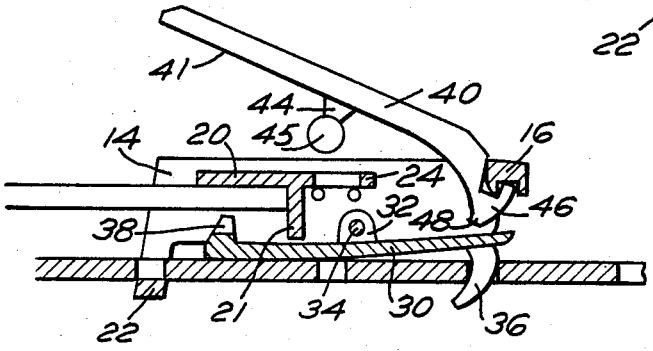
FIG. 2 is a longitudinal sectional view showing the buckle in open position and with the belt strap members in position.
Figure 4:
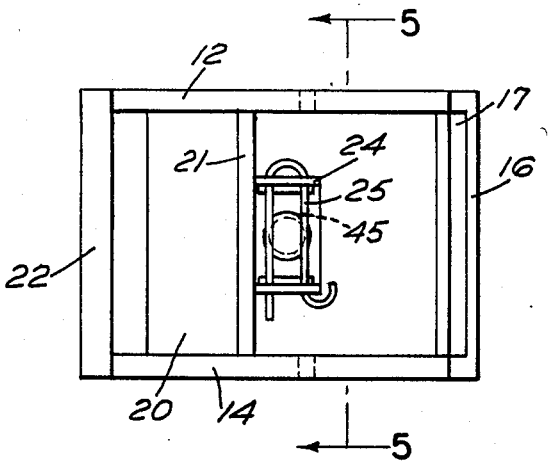
FIG. 4 is a bottom plan view with the locking plate removed for clarity.
Figure 5:
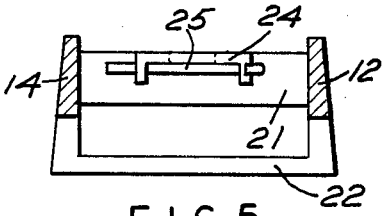
FIG. 5 is a sectional view taken on lines 55 of FIG. 4.
Figure 6:
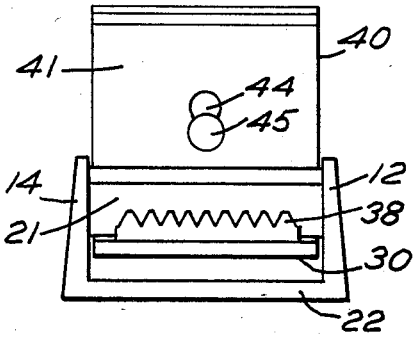
FIG. 6 is an end view taken from the left side of FIG. 2 with the belt removed

In operation the butt end of a belt is inserted against the shelf 20 as seen in FIG. 2. The top member 40 is then pivoted counter clockwise as seen in the drawings to the position as seen in FIG. 3 and as this occurs the protrusion 48 engages the locking plate 30 rocking the same and the jaw 38 will press the butt end of the belt against the shelf 20. In addition the pin 44 will pass down in to the spring 25 that forms a locking member with the enlarged head 45 being gripped beneath the spring member 25. The other end of the belt with the apertures will then be selectively engaged by the pin 36.

I claim:

1. A belt buckle for use with a belt having a first and second end with a first end having at least one aperture extending therethrough, said buckle comprising a separate body and top member adapted to be interconnected with each other, said body member having sides plates connected by a cross bar at one end and a cam bar at the other end, a locking plate pivoted to the side plates and carrying a jaw at one end and a hook pin at the other end, one end of the belt passing over the strap with a hole in the belt engagable by the hook pin, a shelf between the side plates at a position to be aligned with the jaw of the locking plate, and a top member having one end detachably engagable with the cam bar and with a caming protrusion engagable with the locking plate whereby when the butt end of the belt is passed between the jaw and the shelf, pivoting of the top member will rock the locking plate causing the jaw to engage the belt against the shelf and means holding the top member in position.

2. A belt buckle as in Claim 1 wherein the top member has a pin protruding from the underside thereof and the body member has a locking member engagable therewith.

* * * * *